US009771934B2

(12) United States Patent
Gruet

(10) Patent No.: US 9,771,934 B2
(45) Date of Patent: Sep. 26, 2017

(54) ROTARY-PISTON ENGINE

(71) Applicant: William Gruet, Versailles (FR)

(72) Inventor: William Gruet, Versailles (FR)

( * ) Notice: Subject to any disclaimer, the term of this patent is extended or adjusted under 35 U.S.C. 154(b) by 0 days.

(21) Appl. No.: 14/400,278

(22) PCT Filed: May 7, 2013

(86) PCT No.: PCT/FR2013/051021

§ 371 (c)(1),
(2) Date: Nov. 10, 2014

(87) PCT Pub. No.: WO2013/167843

PCT Pub. Date: Nov. 14, 2013

(65) Prior Publication Data

US 2015/0093278 A1 Apr. 2, 2015

(30) Foreign Application Priority Data

May 10, 2012 (FR) ..... 12 54259
Sep. 4, 2012 (FR) ..... 12 58215
Dec. 19, 2012 (FR) ..... 12 62295

(51) Int. Cl.
*F04C 2/26* (2006.01)
*F01C 1/28* (2006.01)
*F01C 1/36* (2006.01)

(52) U.S. Cl.
CPC ..... *F04C 2/26* (2013.01); *F01C 1/28* (2013.01); *F01C 1/36* (2013.01)

(58) Field of Classification Search
CPC ..... F04C 2/26; F01C 1/28; F01C 1/36
USPC ..... 123/200, 222, 232; 418/196
See application file for complete search history.

(56) References Cited

U.S. PATENT DOCUMENTS 1,003,263 A * 9/1911 Humphreys ..... F01C 1/28 123/222
1,226,745 A * 5/1917 Brooks ..... F02B 53/00 123/210
1,239,694 A * 9/1917 Jackman et al. ..... F02B 53/00 123/246

(Continued)

FOREIGN PATENT DOCUMENTS

DE 20216762 U1 * 1/2003 ..... F01C 1/28
FR 1489283 A 7/1967

(Continued)

OTHER PUBLICATIONS

International Search Report dated Nov. 19, 2013 re: PCT/FR2013/051021; citing: WO 2007/026323 A1, JP H10 311 224 A and GB 570 776 A.

(Continued)

*Primary Examiner* — Phutthiwat Wongwian
*Assistant Examiner* — Jason T Newton
(74) *Attorney, Agent, or Firm* — Burris Law, PLLC

(57) ABSTRACT

The present invention relates to an engine or pump called rotary piston engine or pump, comprising a shape of revolution F relative to a delta axis, and rotatably movable about said delta axis in relation to an envelope V, and n cavities distributed over the perimeter of F. In each cavity is housed a rotating roller, characterized in that at least one roller has its center angle determined so as to obtain the closed volumes it delimits, as large as possible.

11 Claims, 9 Drawing Sheets

BB

AA

(56) References Cited

U.S. PATENT DOCUMENTS 1,970,594 A * 8/1934 Brady ..... F02B 53/00 123/232
2,070,631 A * 2/1937 Sunderland ..... F02B 53/00 123/229
2,275,205 A * 3/1942 Straub ..... F02B 53/00 123/206
2,856,120 A * 10/1958 Ibrahim ..... F04C 18/20 418/141
2,870,752 A * 1/1959 Breelle ..... F01C 1/20 123/246
3,435,808 A * 4/1969 Allender ..... F02B 53/00 123/232
3,621,820 A * 11/1971 Newsome ..... F02B 53/00 123/246
3,799,126 A * 3/1974 Park ..... F01C 1/28 123/222
4,057,035 A * 11/1977 Su ..... F01C 1/20 123/232
4,083,663 A * 4/1978 Montalvo ..... F01C 1/28 123/222
5,595,154 A * 1/1997 Smith ..... F01C 1/20 123/222
5,819,699 A 10/1998 Burns
6,129,067 A * 10/2000 Riley ..... F01C 1/20 123/232
7,188,602 B1 3/2007 Campbell
7,201,134 B2 * 4/2007 Guest ..... F01C 1/20 123/232

FOREIGN PATENT DOCUMENTS

GB 570776 A 7/1945
JP 10311224 A 11/1998
WO 2007026323 A1 3/2007

OTHER PUBLICATIONS

Nternational Preliminary Report on Patentability dated Nov. 19, 2013 re: PCT/FR2013/051021; citing: WO 2007/026323 A1 and JP H10 311 224 A.

* cited by examiner r: 6.50
μ: 61.00
ω: 59.00 r: 6.50
μ: 53.00
ω: 44.50 r: 6.50
μ: 48.00
ω: 36.50 r: 5.40
μ: 49.00
ω: 35.00

ROTARY-PISTON ENGINE

TECHNICAL FIELD

The present invention relates to engines and pumps called rotary piston engines and pumps.

BACKGROUND

The current combustion engines are constituted of a piston linearly moving, and this linear motion is transformed into circular motion by a connecting rod and a crankshaft. This motion which changes direction several dozens or hundreds of times per second is a real problem, well known, which we do not intend to go over again. Hence the idea of trying to design an engine with a piston that would have a circular motion. There is no real answer to that so far, although the interest and the concern are significant.

The only rotary piston engine that has been built in series is the <<Wankel >> engine. However, its defects, which are related to its complexity, have resulted in that it has never really succeeded to impose itself, despite the massive investments in research and development to which it has been repeatedly subjected.

Engines of the same category as the one that will be exhibited here, have been the object of patents: U.S. Pat. No. 1,003,263A(1911), GB 570 776 A (1945), FR 1 489 283 A (1967), U.S. Pat. No. 7,188,602 B1 (2007), and U.S. Pat. No. 5,819,699 A (1998).

None of these engines has been manufactured or has given any follow-up.

None of these patents mentions a passage of fluid from one side of the piston to the other.

Moreover, in patents U.S. Pat. No. 1,003,263A, U.S. Pat. No. 7,188,602 B1 and U.S. Pat. No. 5,819,699 A, the secondary piston, or roller, has a flat elliptical shape contrary to the shape of the roller of the engine exhibited here.

In patent FR 1 489 283 A, the roller remains parallel to itself, while this particular case is excluded here, because considered as ineffective.

The closest concept is described in GB 570 776 A. GB 570 776 A discloses an engine having a different result of the engine exhibited here for at least 2 reasons: the piston and the roller do not rotate at proportional rotational speeds (a gears system with 2 diameters changes the speed ratio during the cycle) and the main piston has a different shape.

In GB 570 776A, no indication is given on the way to obtain the desired geometry, does not demonstrate the existence of a geometric solution to the posed problem, which is far from being evident especially when the tip of the rotary piston is enlarged as is the case. Moreover, the roller has a center angle of 180°, contrary to the solution exhibited here, in which this angle is lower than 180°. It is shown that if this angle is not lower than 180°, in the range of 100° to 160°, the engine has reduced characteristics.

Recall that a mechanical system allowing obtaining a variable volume, allows creating pumps, engines if it is rigid enough. The engine may be an internal combustion engine, or driven by a pressurized fluid.

We will henceforth use the term engine, but it should be understood as heat engine or engine driven by a pressurized fluid (steam, oil, air, etc.), or pump (suction pump, pressure pump, . . . ).

BRIEF SUMMARY

To do so, the present invention relates to an engine mainly comprising:

- a shape F of revolution relative to a delta axis and rotatably movable about said delta axis in relation to an envelope V. Which means that this shape F may be movable, and, in this case, has a rotational motion about its delta axis. It may also be fixed, and in this case, it is the envelope V which rotates about delta. F and V may both rotate about delta, and it is the relative rotation which will be taken into account.
- F includes n (n being an integer) cavities A_i (i being the $i^{th}$, and i<=n) which are shapes of revolution of axis β_i. They are distributed over the perimeter of F. the intersections of each cavity A_i with the shape F are: T_i and U_i.
- in each cavity A_i is housed a roller G_i which rotates about the axis β_i, and has at least 2 faces, G_i_1 and G_i_2. The first of these faces G_i_1 is capable of ensuring sealing with the cavity A_i at some moments of the cycle of the engine when this face is inside the cavity A_i. The section by a plane perpendicular to β_i is an arc of circle (R_i, S_i) centered on β_i in P_i, with ends R_i and S_i, with a center angle (R_i, P_i, S_i), that might also be called center angle (G_i_1). The position of G_i might be traced by the position of the center P_i and the angle of rotation θ of the axis of symmetry (P_i,z) of the arc (R_i, S_i) relative to an initial position.

a mechanical means (such as a set of gears, belts, preferably toothed, transmission axes, etc.), that makes the rotation of each G_i about β_i proportional to the relative rotation of delta axis of the shape F relative to the envelope V.

Thus, assuming that there has been defined:

an orthonormal reference frame Ox, Ow an initial position of the system: Pos_0 at a time point t0, the angle ω(t) for tracing the relative rotation of the shape F relative to the envelope V, thus, when the shape F completes a revolution)(ω=360° relative to the envelope V, each G_i completes m revolutions relative to its initial position, m being an integer, positive or negative depending on the direction.

In other words, at every time point t, θ(t)=m*ω(t), t being the time m is excluded from 2 particular cases:

a) m=1, because the roller then rotates as if it were secured to F, and b) m=0, because in this case, P_iy is always parallel to Ox, and this case is considered as having no interest.

- the envelope V which, if it is movable, rotates about the delta axis, and which is the envelope generated by the rollers G_i in their rotational motion about the β_i themselves driven by F, and the relative rotation about the delta axis of the shape F relative to the envelope V.
- the face G_i_2 of G_i is the envelope generated by the envelope V at the level of G_i. Thus sealing between G_i and the envelope V is ensured, the assembly is carried out so that, if we consider a section by a plane perpendicular to delta, the envelope V, the shape F and one of the ends of the arc of circle G_i_1 of G_i: either R_i, or S_i, are in contact in a same location, at a particular moment of the cycle.

The first position such as that, related to G_1, is the position Pos_1, obtained for an angle ω=ω1 (called limit angle), the location: common to V, F and G_1: C1.

Side walls or flanges J1 and J2 over which the shape F, the rollers G_i, and the envelope V bear, The envelope V, the shape F, the rollers G_i, the flanges J1 and J2, delimit volumes that are closed and variable at different moments of the cycle of the relative rotation of F relative to V.

To ensure sealing of the closed volume, the different parts may be provided with gaskets, segments, or any other sealing means.

The whole will henceforth be called engine.

Advantageously, at least one roller G_i has its center angle (G_i_1) determined so as to obtain the closed volumes it delimits, as large as possible, taking into account the other parameters of the system, constraints such as carrying out and design constraints (manufacturing constraints, material strength constraints, problems related to sealing, etc.).

Advantageously, at least one roller G_i has its center angle (G_i_1) lower than 180°.

In fact, if the maximum closed volume is considered based on the center angle (G_i_1), although the curve depends on the different geometric characteristics of the system, a maximum is found for an angle lower than 180°, often clearly lower, around 130°.

The envelope V has peaks, or ends Qa, Qb, and even Qc, . . . according to the values of m. If we consider, for example Qa, this end delimits, at one moment of the cycle, a variable volume on each one of its faces, on one side with G_i−1 and on the other, with G_i.

Advantageously, the center angle (G_i_1) of at least one roller G_i is determined so as to close the preceding volume to begin the compression in this volume, at the same time as it opens the next closed volume to allow the evacuation of burnt gases.

The ends Q of the envelope V, according to the basic geometric design, have an angular shape. They may be enlarged for reasons related to strength of materials subjected to strong constraints, sealing, manufacturing, etc.

It has not hitherto been precised, which, among the shape of revolution F and the envelope V, is inside the other.

Advantageously, in a first implementation, the shape of revolution F is in the outside relative to the envelope V (and consequently, the envelope V, is in the inside relative to the shape F revolution).

It may be said that in this case, we have a rotary piston inside the assembly, of which V is the outer surface. Outside of the assembly, we have a frame that may be fixed the inner surface of which is the shape F and the cavities. This frame carries the axes β_i, and the n cavities A_i are extruded over its inner surface.

Advantageously, in a $2^{nd}$ implementation, the shape of revolution F is in the inside relative to the envelope V (and consequently, the envelope V, is in the outside relative to the shape of revolution F).

It may be said that in this last case, we have a rotary piston inside the assembly of which F and the cavities form the outer surface. This piston carries the axes β_i. Outside of the assembly, we have a frame that may be fixed the inner surface of which is the envelope V.

Advantageously, at least 2 cavities A_i and A_i+1 are contiguous, that is to say they are as close as possible. They remain separated, but the separations therebetween have a thickness reduced to minimum, taking into account material strength, sealing, and design constraints: as will be explained later, close nevertheless means a small distance between 2 consecutive cavities, in order to be able to arrange a passage of fluid from one side to the other of the envelope V. Moreover, if the ends of the envelope V do not comprise peaks, but are enlarged, this also contributes to enlarge the separation.

If the number of cavities is odd, the explosions take place one at a time, and the operation is thereby more regular.

For this type of rotary engines, it is essential to be able, in one way or another, to make the compressed fluid on one side of one end Q of the envelope V, pass toward the closed volume of the other side of this end Q. The fluid remains compressed because it is entrapped between 2 rollers in their consecutive respective cavities, the shape F and the envelope V. In a heat engine, the explosion takes place at this time point, and thus, the pressure on this other side of Q makes the envelope rotate in the correct direction.

Advantageously, between at least 2 consecutive cavities A_i and A_i+1, a passage is arranged so that, when one end Q of the envelope V is between these 2 cavities, the fluid that has been compressed by one of the faces of the end Q of the envelope V, could pass on the other face (over which the fluid, after explosion, will expand).

A pre-combustion chamber may be arranged with the passage.

Advantageously, the axes β_i are parallel to delta and located at a same distance from delta d=distance (OP).

Advantageously, the shapes F, A_i, G_i, and V, are cylindrical with generatrices parallel to delta.

In this case, the rollers G_i have their section along a plane passing through beta_i which is a rectangle, and the section of V along a plane passing through delta is also a rectangle. It may be interesting to be able to round the corners of the rectangles.

Advantageously, the rollers are such that the section of G_i along a plane passing through beta_i is a non-rectangular surface. The envelope V is drawn accordingly.

The new drawing of the rollers and of V also allows integrating the sealing gaskets (or segments).

The engine (or pump) still may operate with various valves or clappers, but it may be preferable to avoid them when possible, and to have permanently open intake and/or exhaust openings.

For this purpose, advantageously, the intake of fresh gases passes by the inside of the central rotary piston.

For the same reasons, advantageously, the exhaust of burnt gases, passes by the inside of the central rotary piston.

BRIEF DESCRIPTION OF THE DRAWINGS

The following figures and the descriptions of some particular implementations will allow a better understanding.

FIGS. 1 to 23C cover embodiments according to the $1^{st}$ implementation, that is to say, the shape F is in the outside, the envelope V is in the inside. The shape F is fixed, and the envelope V rotates. The envelope V is the central rotary piston.

FIGS. 1 to 5 show different steps of the design of a first embodiment of an engine according to the invention allowing obtaining the geometric shapes of said engine.

FIGS. 6 to 11 illustrate the different steps of an operating cycle of an engine according to the invention.

FIGS. 12 to 16 show engines with rollers having different values of the center angle.

FIG. 17 shows the value of the limit angle ω1 and the length OQ based on the value of the half-center angle of the rollers (μ).

FIGS. 19 to 22 show some examples with different coefficients m and different values of the number of cavities.

FIG. 23C shows non-rectangular sections of G_i.

DETAILED DESCRIPTION

In these examples, the axes β_i are parallel to delta and located at a same distance d from delta.

The shape F and its cavities A_i, the rollers G_i, the envelope V are cylindrical with their generatrices parallel to delta. The side walls J1 and J2 are perpendicular to delta.

Figure 23A:
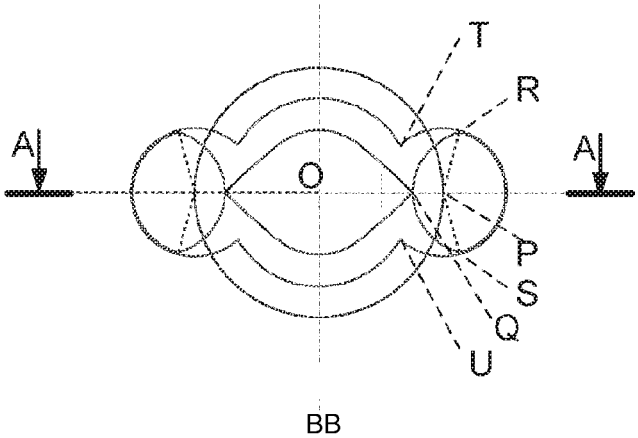
FIGS. 23A and 23B show an example of driving with gears.
Figure 23B:
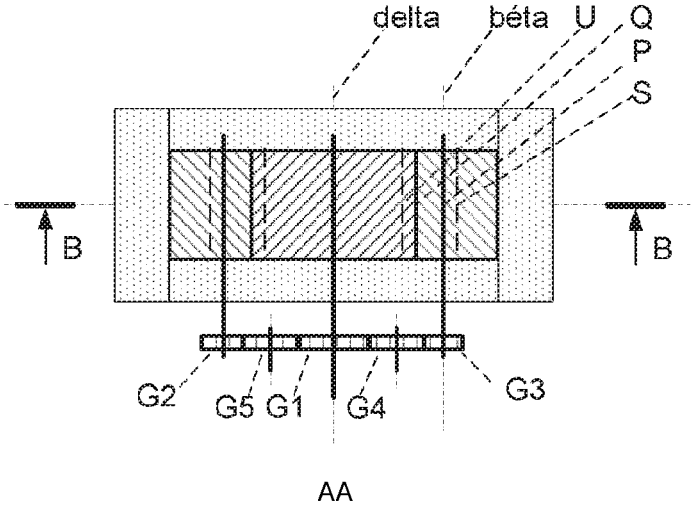
Figure 23C:
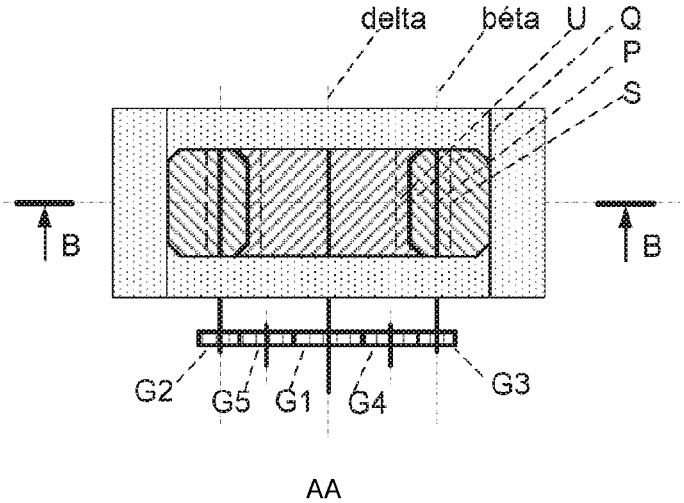

In these conditions, it is preferable, in order to understand, to represent the system by a section BB by a plane perpendicular to the delta axis (FIG. 23).

In order not to overload the writings on the drawings, regarding the 1st roller G_1, the point P_1, the cavity A_1, they will be noted G, P, A, the same applies for the other elements of G_1. For the other rollers, the elements G_i, P_i, A_i, etc. will be noted Gi, Pi, Ai on the figures.

Figure 1:
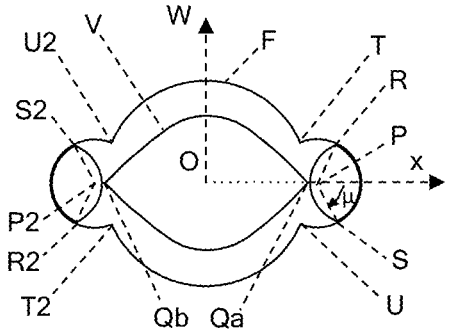

FIG. 1: the system is in the initial position Pos_0, in which a horizontal axis Ox, is an axis of symmetry of the assembly. The piston F is positioned so that the cavity A_1 is on this axis Ox, the 1st face G_1_1 is in its cavity.

On this figure, we distinguish:

O, the intersection of the cutting plane with the delta axis,

P, and P2 the intersection of the cutting plane with the axes beta_1 and beta_2. They are the centers of cavities A and A2, and the rotation centers of rollers G and G2.

The shape F,

The envelope V, its end Qa toward the cavity A1 (in the position Pos_0), and the other end Qb.

In this position Pos_0, V and G are in contact in Q.

This point Q in the fixed reference frame Ox, Ow, is Q0 (0 for Pos_0).

Qa is a point of V, which we will call Qa0, and a point of G, which we will call qa0.

The rollers G, with a half-center angle μ the ends of which are R and S, with the axis of symmetry Py, and the roller G2, the ends of which are R2, and S2, On the other figures:

ω is the angle of rotation (Ox, Oy) of the piston V,

θ is the angle of rotation (Ox, Oz) of the roller G. Here, θ=2*ω (m=2).

The initial data are:

n equal to 2 m equal to 2

The distance d, equal to distance (OP)

the radius r of the center angle (R,P,S)

the half-angle μ of the center angle (R, P, S) of the roller G,

From these data, we will draw the rest of the system.

Figure 2:
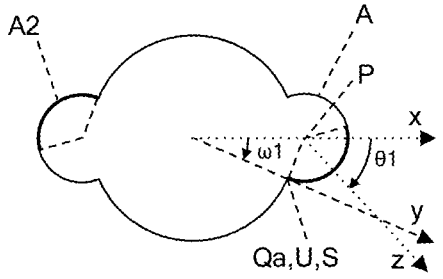

FIG. 2 corresponds to the position Pos_1, where the points Q, S and U meet.

This figure allows determining w1, and the radius R of the shape F. Indeed, by observing the triangles, it is found that:

$$d*\sin(\omega 1)=r*\sin(\mu+(m-1)*\omega 1), \text{ and}$$

$$R=d*\cos(\omega 1)+r*\cos(\mu+(m-1)*\omega 1)$$

Figure 3:
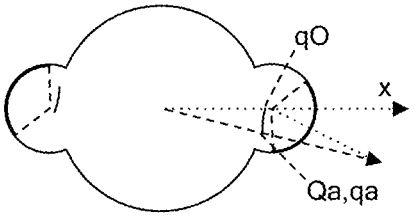

FIG. 3: it is question of determining the arc of curve G_1_2 of G.

For this purpose, let's return in Pos_0. qa0 is a 1st point of G_1_2. Let's increase ω from 0 to ω1. At each time point t and at each value of ω(t), Qa is the point of V in contact with G in qa (qa being a point of G). The half-curve G_1_2 of G is the set of points qa.

The last point is S. The other half-curve is obtained by symmetry.

Figure 4:
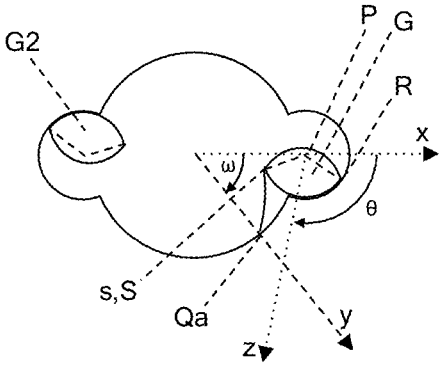

FIG. 4: the 1st portion of the envelope V is determined.

For this purpose, let's start from Pos_1. Q is the 1st point of the researched envelope arc. Let's increase ω from ω1 until (P,S) becomes aligned with Ox. At each time point t and at each value of ω(t), S is the point of G in contact with V in s, s being a point of V.

The 1st portion of the envelope V is the set of points s.

Figure 5:
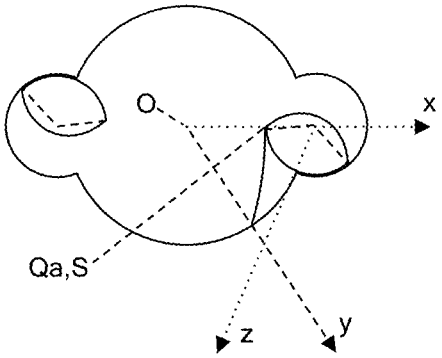

FIG. 5, the position is Pos_2: (P,S) is aligned with Ox and ω=ω2. Let's increase ω from ω2 to 90°. This portion of the envelope V is an arc of circle with center O, with radius d-r.

The rest of the piston is obtained, in this case, by 2 symmetries.

We have hence seen that G_1_2 and the envelope V have been obtained independently. The curve G_1_2 has been <<machined>> by Qa (<<machine>> in the sense that Qa would be a cutting tool which would machine the material to give G_1_2 its shape, Qa and G_1_2 being driven in their respective rotational motions as precedingly defined), and the 1st portion of the envelope V has been <<machined>> by S.

These curves have been obtained point-by-point to contribute to the understanding. They may also be obtained analytically.

That was one approach. There are others. For example, assuming that we are led to consider that the ends Q of the piston must be larger, for example, for reasons related to sealing, manufacturing, or because the significant pressure at the moment of explosion, leads to enlarge the ends Q of the piston.

The <<improved piston>> is then drawn, then it is this piston which will machine>> the rollers. This <<improved piston>> may be non-symmetrical; in this case, the curve arc G_I_2 is no longer symmetrical.

For example, the shape of the piston Q may be rounded at its ends Qa and Qb, in order to be easier to machine (a rounded milling cutter is less expensive than the tools for machining more complex shapes). The principle remains the same, it is Qa which <<will machine>> the 1st portion of the arc G_1_2.

Another example, if the ends of Q are no longer a tip, but 2 points Qaa, and Qab (for Qa) separated by a small distance compatible with the material strength constraints, and such that OQaa=OQab=d, to simplify, let's not take into account the shape of the piston between these 2 points, it is Qaa which <<will machine>> the 1st portion of the arc G_1_2 (the 2nd by Qab, which will be symmetrical).

In a more general way, any modification relative to the basic drawing is possible, provided that the rollers G and the envelope V remain in contact at every time point, that is to say that one is the envelope of the other in their respective motions.

FIGS. 6 to 11 show the operation of an engine with four rollers according to the invention.

Figure 6:
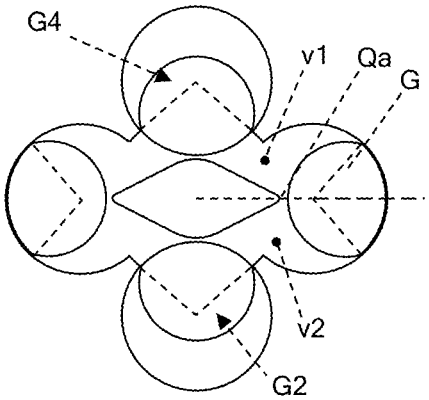

FIG. 6: the volume v2 has just been closed by the roller G2. It contains the fresh air to be compressed. In this example, the center angle μ=90°−ω1, so that the roller G2 closes v2, at the same time as the roller G4 opens the volume v1.

Figure 7:
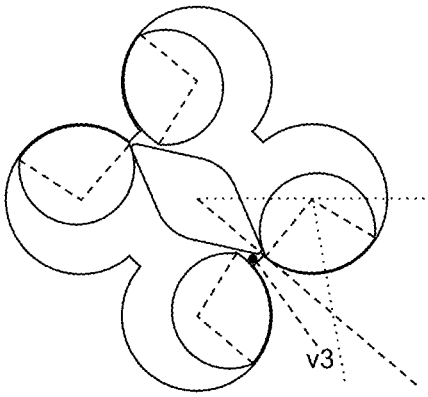

FIG. 7: ω=ω1, the air volume v2 has been compressed and occupies the volume v3.

Figure 8:
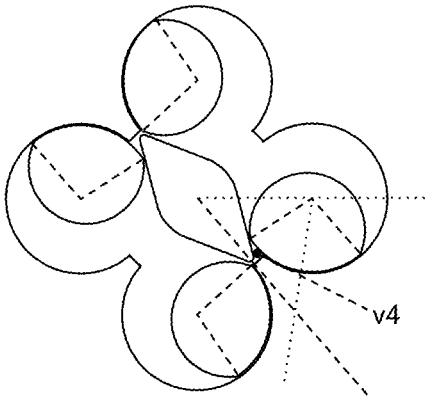

FIG. 8: the volume v3 has passed in v4, on the other side of Qa by an adequate passage (not represented). At this time point the injection then the explosion may take place. The burnt gases exert a strong pressure on the central piston which makes it rotate.

Figure 9:
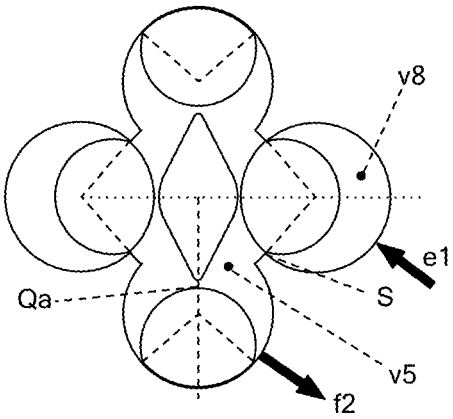

FIG. 9: It is the end of the expansion, the volume v4 has increased until becoming the maximum volume v5.

Figure 10:
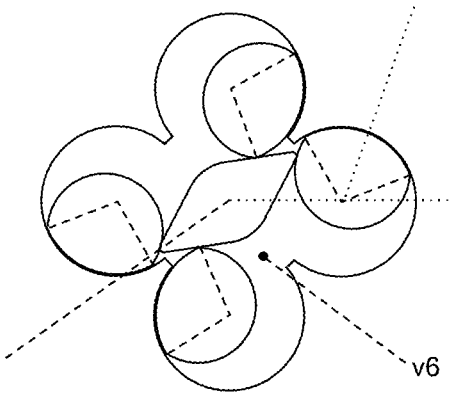

FIG. 10: A quarter-turn is disposed to evacuate the burnt gases and fill the volume v6 with fresh air. The intake and exhaust valves are not represented.

Figure 11:
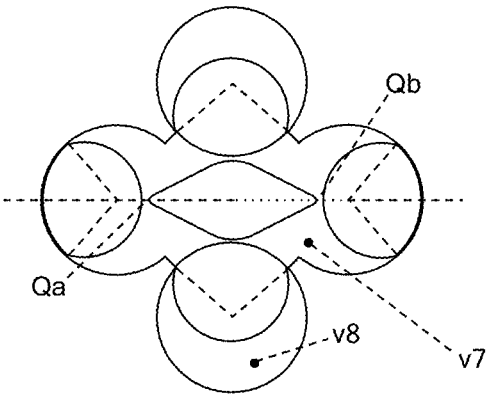
Figure 12:
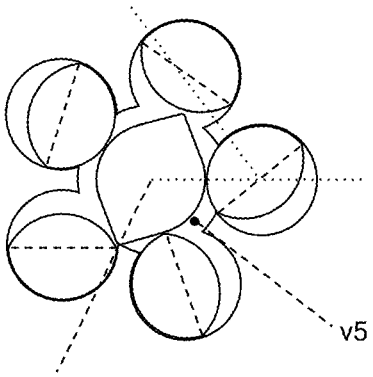

FIG. 11: the volume v7 contains fresh air, and the roller L1 closes the volume. We end up in the situation of FIG. 10.

The exhaust and the intake may be performed in different ways and in accordance with the configuration. For example, here the exhaust may be performed at the level of f2 (FIG. 9). The intake may be performed at the level of e1 the bottom of the cavity v8 may be filled in advance with fresh air at low pressure, so that it will more quickly get rid of the remainder of burnt gases toward f2, upon the opening at the level of S.

It may be found that, contrary to conventional cylinder engines, the valves (or clappers) are not in a fire area (where the explosion takes place) thus giving more freedom for their implementation.

This operation resembles that of a two-stroke engine (compression, expansion, and exhaust/intake). We might describe an operation resembling that of a four-stroke engine, the complete cycle is then performed over 2 revolutions.

FIGS. 12 to 16 show the influence of the center angle on the characteristics of the engine. These figures show, for different values of p, the maximum volume v5 for the expanded gases. The length d and the radius r are the same in all these figures.

FIG. 12: $\mu=90°$

Figure 13:
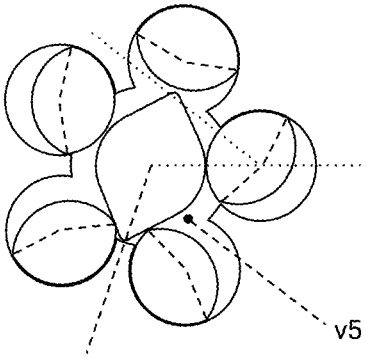

FIG. 13: $\mu=80$: we see that, compared to the preceding case, for a difference of only 10°, the volume v5 is substantially larger, almost the double.

Figure 14:
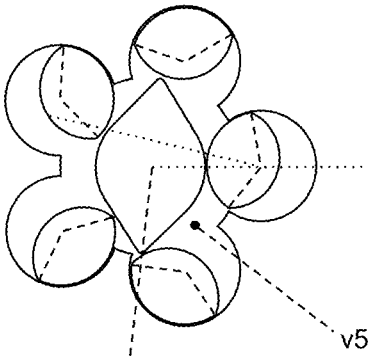

FIG. 14: $\mu=66$: we see that, compared to the preceding case, the volume has almost doubled again.

Figure 15:
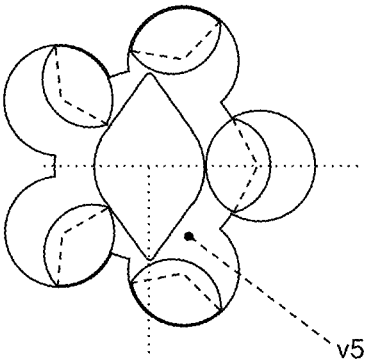

FIG. 15: $\mu=90°-\omega 1$ namely almost 60° here. For this value, the roller G_1 closes the preceding volume v8, and opens the volume v5 at the same time point. The volume v5 is slightly different relative to the preceding case: a ceiling is put.

Figure 16:
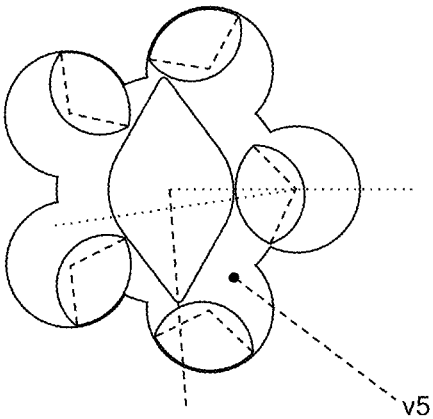

FIG. 16: $\mu=55°$: we see that, compared to the preceding case, the volume v5 has slightly changed. It is found that for $p<90°-\omega 1$, the volume at the bottom of the cavity is never enclosed.

We hence see that the maximum volume v5 has increased when $\mu$ has decreased, until to reach a ceiling and that the value to be retained is located in that vicinity, while taking into account different constraints.

Figure 17:
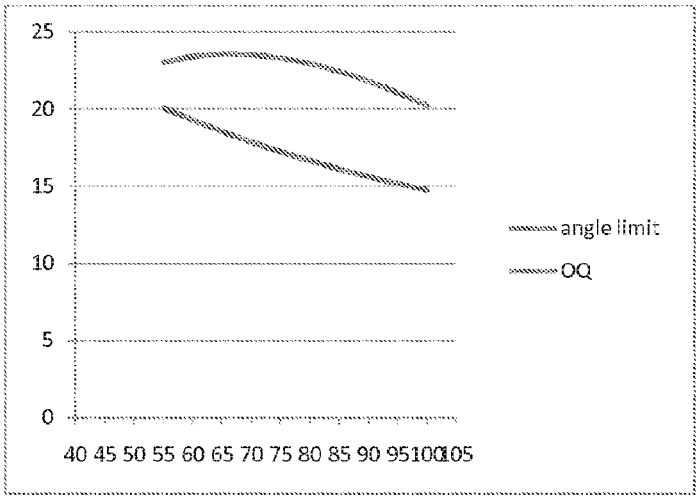

FIG. 17 shows that $\omega 1$ also passes through a maximum, obtained for about 65°. We also see that the distance OQ increases when $\mu$ decreases. Although this is not formally demonstrated here, the maximum of $\omega 1$ and the maximum of v5 are located in the same vicinity of values.

These results have been explained for a particular value of the ratio r/d, but it might be demonstrated that they are general.

What is true for the expansion of gases is also true for the compression because there is symmetry.

This leads to the conclusion that $\mu=90°$ is not an ideal choice. For the engine to be more efficient, $\mu$ must preferably be lower than 90°.

Figure 18A:
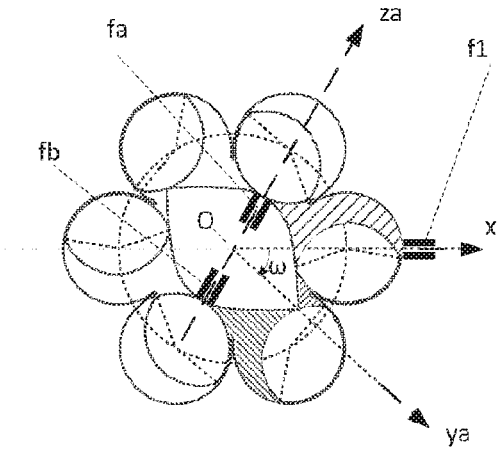
FIGS. 18A and 18B show a valveless engine.
Figure 18B:
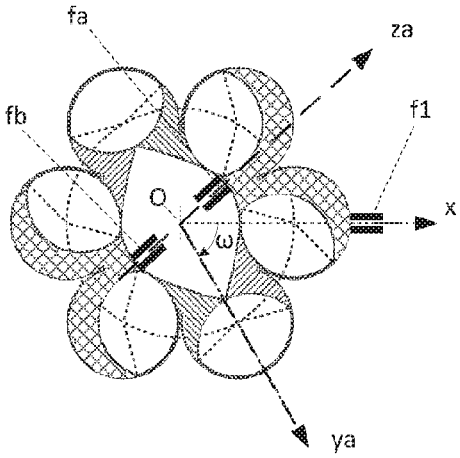

FIGS. 18A and 18B give an example of valveless operation, the fresh air passing by the inside of the central piston, and passing through the arc of circle shaped portion of this piston. The 2 intake valves fa and fb are represented. Only the exhaust valve f1 on G has been represented; there is one for each roller.

The upwardly hatched area (by proceeding from left to right) corresponds to fresh air to be compressed, the downwardly hatched area corresponds to expanding burnt gases, the squared area corresponds to burnt gases, being replaced by fresh air.

In the preceding figures, the rotation speed ratio is m=2.

This rotation speed ratio m may be different. FIGS. 19 to 22 show some examples with coefficients m ranging from 3 to 5.

Figure 19:
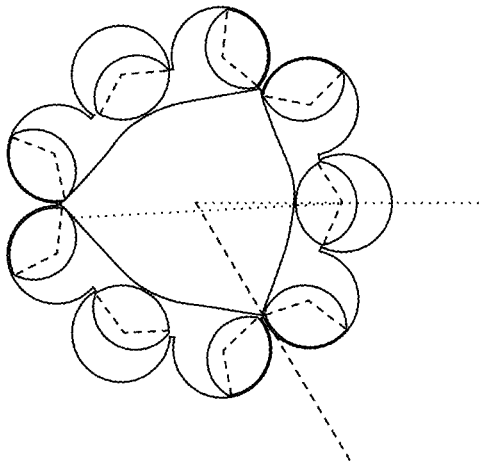

FIG. 19: m=3 and 9 cavities.

Figure 20:
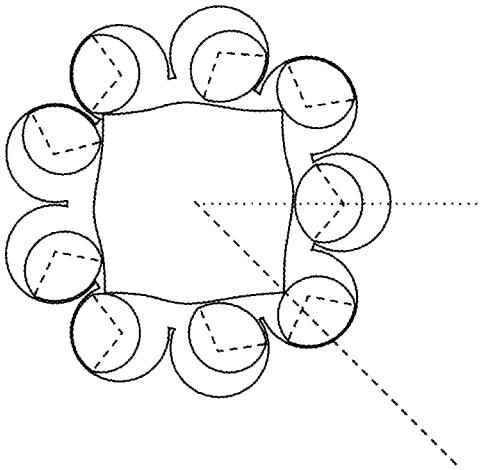

FIG. 20: m=4 and 9 cavities.

Figure 21:
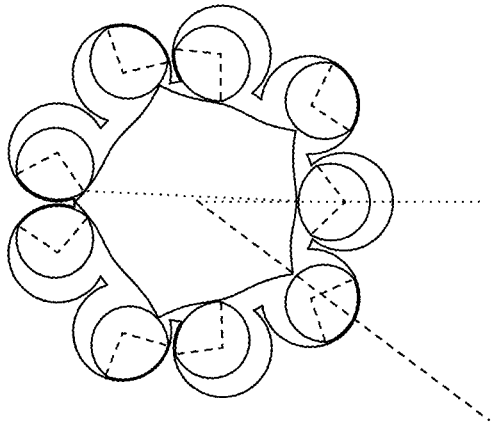

FIG. 21: m=5 and 9 cavities.

Figure 22:
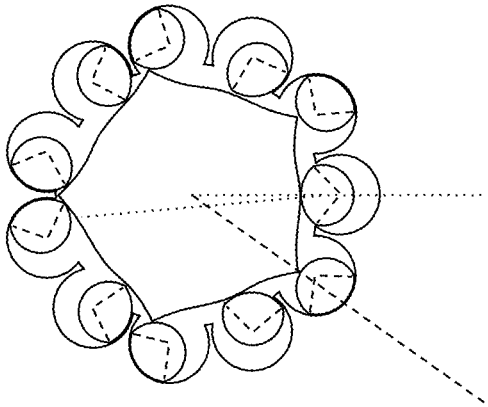

FIG. 22: m=5 and 11 cavities.

FIGS. 23A and 23B show an example of driving with gears. The wheels G1 to G5 give the rotation direction and the ratio m.

On FIG. 23B, the section AA, the sections of V and the rollers comprise (hatched) rectangles because all the generatrices are parallel to delta. But the rollers may be different, in particular at the outer angles. The envelope V is consequently modified. FIG. 23B shows chamfered rollers. They might also be rounded. More generally, any modification relative to the basic drawing is possible, provided that the rollers G and the envelope V remain in contact at every time point, that is to say that one is the envelope of the other in their respective motions.

FIGS. 24 to 31A cover embodiments according to the $2^{nd}$ implementation, that is to say, the shape F is in the inside, the envelope V is in the outside. Here, the shape F rotates, and the envelope V is fixed. The shape F is the central rotary piston.

All what has been said for the $1^{st}$ implementation and which remains valid for the $2^{nd}$ is not repeated here.

Figure 24:
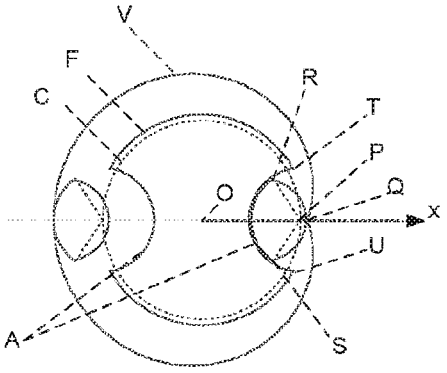
FIGS. 24 to 31B show a second embodiment of an engine according to the invention.

FIG. 24 shows the engine in the position Pos_0.

Figure 25:
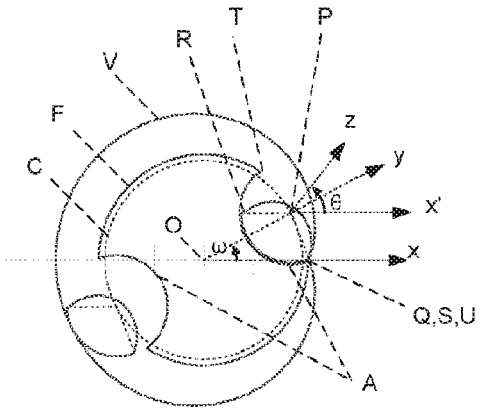
Figure 26:
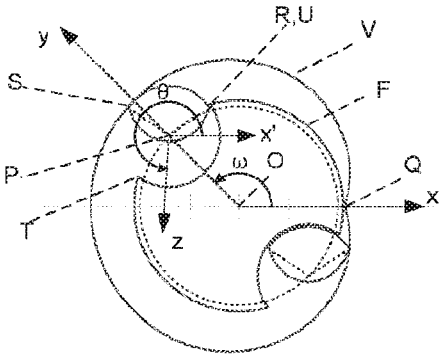
Figure 27:
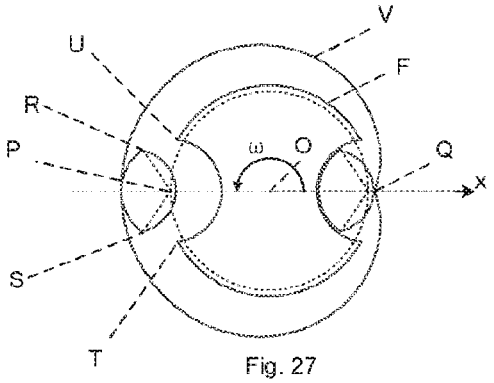
Figure 28:
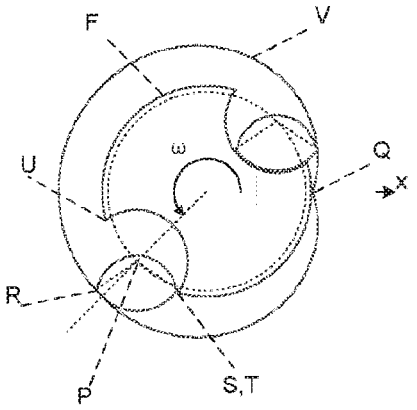
Figure 29:
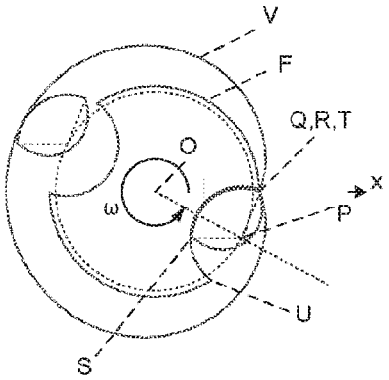

FIG. 25 shows how to obtain $\omega 1$ and OQ.

FIGS. 26 to 29 show the operation.

Figure 30:
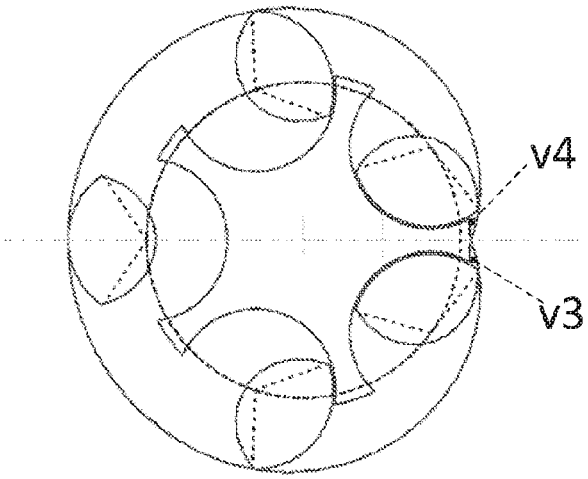

FIG. 30 corresponds to FIG. 7 of the $1^{st}$ implementation, with close rollers. The volume v3 of compressed air passes to the other side of the envelope V in v4 by a passage which is not represented.

Figure 31A:
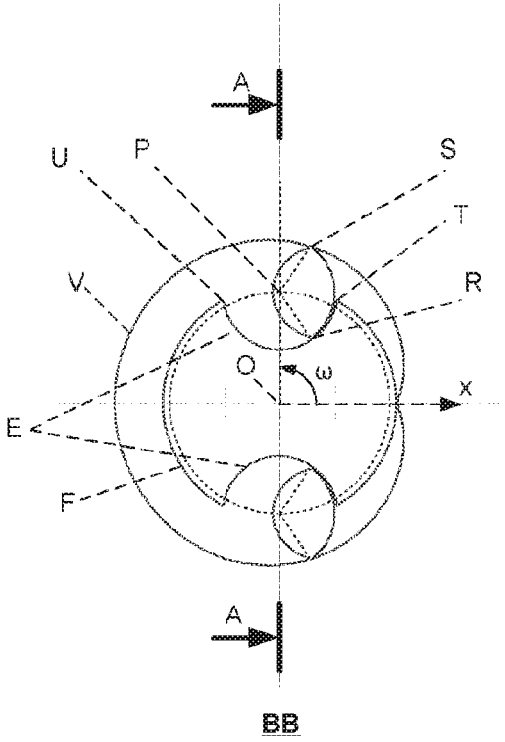
Figure 31B:
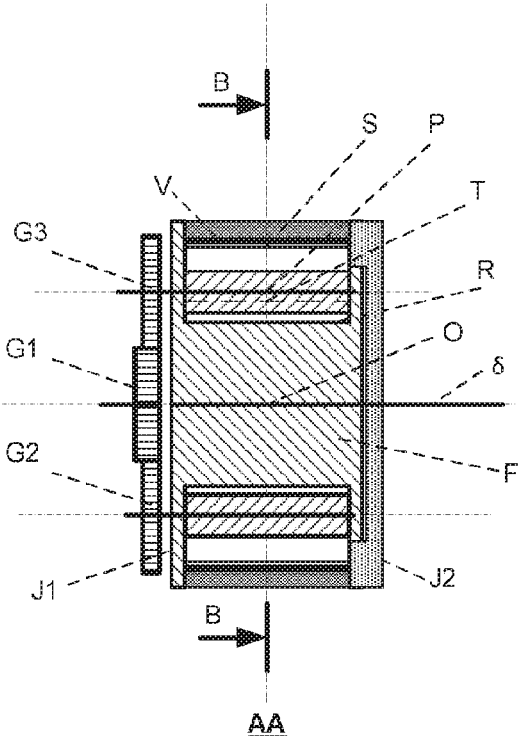

FIGS. 31A and 31B show an example of driving with gears.

The rotary piston engine is presented as an intermediary solution between the engine with cylinders and pistons, and the turbine engine. The possible applications are numerous (engines, pumps, compressors, . . . ).

Compared to the engines with cylinders and pistons, the removal of this considerably anti-mechanical reciprocating linear motion of the piston, the simplicity, the absence of vibration, will allow economical and reliable operations with little wear.

Compared to the turbines (gas turbines, steam turbines, pressurized-fluid turbines, etc.), the efficiency will be considerably higher.

This engine is also suitable for the carrying out of non-polluting gas engines or hydrogen engines.

The invention claimed is:

1. A rotary piston engine, comprising:

a shape of revolution relative to a delta axis, and rotatably movable about the delta axis in relation to an envelope, a plurality of cavities which are shapes of revolution of a corresponding axis, distributed over a perimeter of the shape of revolution, a plurality of rollers each disposed in a corresponding one of the plurality of cavities, each roller of the plurality of rollers rotates about the corresponding axis and further includes at least a first face and a second face, wherein the first face is capable of ensuring sealing with at least one cavity of the plurality of cavities at some moments of a cycle of the engine when the first face is inside the at least one cavity and a section of each roller, as viewed in a plane perpendicular to the corresponding axis, is an arc of circle centered on the corresponding axis, with a center angle, a mechanical component configured to make the rotation of each roller of the plurality of rollers about the corresponding axis proportional to the relative rotation of the delta axis of the shape relative to the envelope, the envelope being defined by a first plurality of the plurality of rollers in their rotational motion about their corresponding axis, each driven by the shape of revolution and the relative rotation of the delta axis of the shape of revolution relative to the envelope, the second face ensuring sealing between each roller and the envelope, a section of the engine, when viewed in a plane perpendicular to the delta axis, the envelope, the shape of revolution and one of the ends of the arc of circle of the first face, are in contact, in a same location, at a particular moment of a cycle of the engine, side walls or a first flange and a second flange over which the shape of revolution, the roller, and the envelope bear, the shape, the rollers, the envelope, and the flanges, cooperatively delimiting volumes that are closed and variable at different moments of the cycle of the engine of the relative rotation of the shape of revolution relative to the envelope, the engine being wherein at least two cavities of the plurality of cavities are contiguous, and in that, between the at least two contiguous cavities, a passage is arranged so that, when a first end of the envelope is between the at least two contiguous cavities, a fluid that has been compressed by a first face of the first end of the envelope, can pass on a second face of the envelope.

2. The engine according to claim 1, wherein at least one roller of the plurality of rollers has a center angle determined so as to obtain the closed volumes it delimits.

3. The engine according to claim 2, wherein the center angle is lower than 180°.

4. The engine according to claim 1, wherein at least one roller of the plurality of rollers has a center angle determined so as to close the preceding volume, at the same time as it opens the next closed volume.

5. The engine according to claim 1, wherein the shape of revolution surrounds the envelope.

6. The engine according to claim 1, wherein the shape of revolution is surrounded by the envelope.

7. The engine according to claim 1, wherein the corresponding axes around which each of the plurality of rollers rotate are parallel to the delta axis and located at a same distance from the delta axis.

8. The engine according to claim 1, wherein the shape of revolution, each of the plurality of cavities, each of the plurality of rollers, and the envelope are cylindrical with generatrices parallel to the delta axis.

9. The engine according to claim 1, wherein the section of each roller of the plurality of rollers disposed along a plane passing through the corresponding axis defines a non-rectangular surface.

10. The engine according to claim 1, wherein an intake of fresh gases passes by the inside of a central rotary piston.

11. The engine according to claim 1, wherein an exhaust of burnt gases passes by the inside of a central rotary position.

* * * * *